US006959737B2

(12) United States Patent
Ward

(10) Patent No.: US 6,959,737 B2
(45) **Date of Patent: *Nov. 1, 2005**

(54) MACHINE DIRECTION YARN STITCHED TRIPLE LAYER PAPERMAKER'S FORMING FABRICS

(75) Inventor: Kevin John Ward, Nova Scotia (CA)

(73) Assignee: Weavexx Corporation, Wake Forest, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/042,719

(22) Filed: Jan. 25, 2005

(65) Prior Publication Data

US 2005/0121097 A1 Jun. 9, 2005

Related U.S. Application Data

(63) Continuation of application No. 10/391,827, filed on Mar. 19, 2003, now Pat. No. 6,896,009.

(51) Int. Cl.[7] ..... D03D 11/00

(52) U.S. Cl. ..... 139/383 A; 139/383 R; 139/383 AA; 442/203; 162/900

(58) Field of Search ..... 139/383 R, 383 A, 139/383 AA; 442/203, 205; 162/900

(56) References Cited

U.S. PATENT DOCUMENTS

| | | | | |
|---|---|---|---|---|
| 2,172,430 | A | 9/1939 | Barrell | 139/383 |
| 2,554,034 | A | 5/1951 | Koester et al. | 139/426 |
| 3,094,149 | A | 6/1963 | Keily | 139/383 |
| 3,325,909 | A | 6/1967 | Clark | 34/95 |
| 4,093,512 | A | 6/1978 | Fleischer | 162/348 |

(Continued)

FOREIGN PATENT DOCUMENTS

| | | | |
|---|---|---|---|
| CA | 1115177 | 12/1981 | 139/58 |
| DE | 454 092 | 12/1927 | |
| DE | 3425808 | 1/1985 | D21F/1/10 |
| DE | 33 29 740 | 3/1985 | D03D/11/00 |
| EP | 0 048 962 | 9/1981 | D03D/1/00 |

(Continued)

OTHER PUBLICATIONS

Warren, C.A., "The Importance of Yarn Properties in Wet–End Wire Construction," Seminar, The Theory of Water Removal, Dec. 12, 1979.

(Continued)

*Primary Examiner*—John J. Calvert
*Assistant Examiner*—Robert H. Muromoto
(74) *Attorney, Agent, or Firm*—Myers Bigel Sibley & Sajovec

(57) ABSTRACT

Triple layer papermaker's forming fabrics having a set of top MD yarns that are interwoven exclusively with a set of top CMD yarns to form at least part of a top fabric layer and a set of bottom MD yarns that are interwoven exclusively with a set of bottom CMD yarns to form at least part of a bottom fabric layer are provided. These fabrics further include a set of stitching MD yarn pairs. The stitching MD yarns that comprise each such pair weave in both the top fabric layer and the bottom fabric layer such that at locations where the first yarn in the pair weaves in the top fabric layer the second yarn in the pair drops down into the bottom fabric layer. In embodiments of the present invention, each stitching MD yarn may also be woven so as to form side-by-side machine direction knuckles on the bottom surface of the bottom fabric layer with a bottom MD yarn. In other embodiments of the invention, at least some of the top CMD yarns that the stitching MD yarns of the stitching MD yarn pairs pass over immediately before dropping down into the bottom fabric layer have a larger diameter and/or a higher modulus than the remainder of the top CMD yarns.

25 Claims, 10 Drawing Sheets

U.S. PATENT DOCUMENTS

| | | | | |
|---|---|---|---|---|
| 4,182,381 | A | 1/1980 | Gisbourne | 139/383 A |
| 4,244,543 | A | 1/1981 | Ericson | 248/55 |
| 4,289,173 | A | 9/1981 | Miller | 139/383 A |
| 4,290,209 | A | 9/1981 | Buchanan et al. | 34/123 |
| 4,414,263 | A | 11/1983 | Miller et al. | 428/234 |
| 4,438,788 | A | 3/1984 | Harwood | 139/383 A |
| 4,452,284 | A | 6/1984 | Eckstein et al. | 139/383 A |
| 4,453,573 | A | 6/1984 | Thompson | 139/383 A |
| 4,501,303 | A | 2/1985 | Osterberg | 139/425 A |
| 4,515,853 | A | 5/1985 | Borel | 428/257 |
| 4,529,013 | A | 7/1985 | Miller | 139/383 A |
| 4,564,052 | A | 1/1986 | Borel | 139/425 A |
| 4,592,395 | A | 6/1986 | Borel | 139/383 A |
| 4,592,396 | A | 6/1986 | Borel et al. | 139/429 |
| 4,605,585 | A | 8/1986 | Johansson | 428/224 |
| 4,611,639 | A | 9/1986 | Bugge | 139/383 A |
| 4,621,663 | A | 11/1986 | Malmendier | 139/383 A |
| 4,633,596 | A | 1/1987 | Josef | 34/116 |
| 4,636,426 | A | 1/1987 | Fleischer | 428/224 |
| 4,642,261 | A | 2/1987 | Fearnhead | 428/225 |
| 4,676,278 | A | 6/1987 | Dutt | 139/383 A |
| 4,705,601 | A | 11/1987 | Chiu | 162/348 |
| 4,709,732 | A | 12/1987 | Kinnunen | 139/383 A |
| 4,729,412 | A | 3/1988 | Bugge | 139/383 A |
| 4,731,281 | A | 3/1988 | Fleischer et al. | 428/196 |
| 4,739,803 | A | 4/1988 | Borel | 139/383 A |
| 4,755,420 | A | 7/1988 | Baker et al. | 428/222 |
| 4,759,975 | A | 7/1988 | Sutherland et al. | 428/234 |
| 4,815,499 | A | 3/1989 | Johnson | 139/383 |
| 4,815,503 | A | 3/1989 | Borel | 139/383 A |
| 4,909,284 | A | 3/1990 | Kositzke | |
| RE33,195 | E | 4/1990 | McDonald et al. | 139/425 A |
| 4,934,414 | A | 6/1990 | Borel | 139/383 A |
| 4,941,514 | A | 7/1990 | Taipale | 139/383 A |
| 4,942,077 | A | 7/1990 | Wendt et al. | 428/152 |
| 4,945,952 | A | 8/1990 | Vöhringer | 139/383 |
| 4,967,805 | A | 11/1990 | Chiu et al. | 139/383 |
| 4,987,929 | A | 1/1991 | Wilson | 139/383 A |
| 4,989,647 | A | 2/1991 | Marchand | 139/383 A |
| 4,989,648 | A | 2/1991 | Tate et al. | 139/383 |
| 4,998,568 | A | 3/1991 | Vöhringer | 139/383 A |
| 4,998,569 | A | 3/1991 | Tate | 139/383 A |
| 5,022,441 | A | 6/1991 | Tate et al. | 139/383 |
| 5,025,839 | A | 6/1991 | Wright | 139/383 A |
| 5,067,526 | A | 11/1991 | Herring | 139/383 |
| 5,074,339 | A | 12/1991 | Vohringer | 139/383 A |
| 5,084,326 | A | 1/1992 | Vohringer | 428/194 |
| 5,092,372 | A | 3/1992 | Fitzka et al. | 139/383 A |
| 5,101,866 | A | 4/1992 | Quigley | 139/383 |
| 5,116,478 | A | 5/1992 | Tate et al. | 162/358 |
| 5,152,326 | A | 10/1992 | Vohringer | 139/383 A |
| 5,158,118 | A | 10/1992 | Tate et al. | 139/383 A |
| 5,219,004 | A | 6/1993 | Chiu | 139/383 A |
| 5,228,482 | A | 7/1993 | Fleischer | 139/383 A |
| 5,277,967 | A | 1/1994 | Zehle et al. | 428/234 |
| 5,358,014 | A | 10/1994 | Kovar | 139/383 A |
| 5,421,374 | A | 6/1995 | Wright | 139/383 A |
| 5,421,375 | A | 6/1995 | Praetzel | 139/383 A |
| 5,429,686 | A | 7/1995 | Chiu et al. | 139/383 |
| 5,437,315 | A | 8/1995 | Ward | 139/383 |
| 5,449,026 | A | 9/1995 | Lee | 139/383 A |
| 5,454,405 | A | 10/1995 | Hawes | 139/383 A |
| 5,456,293 | A | 10/1995 | Ostermayer et al. | 139/383 A |
| 5,465,764 | A | 11/1995 | Eschmann et al. | 139/383 A |
| 5,482,567 | A | 1/1996 | Barreto | 139/383 A |
| 5,487,414 | A | 1/1996 | Kuji et al. | 139/383 |
| 5,518,042 | A | 5/1996 | Wilson | 139/383 A |
| 5,520,225 | A | 5/1996 | Quigley et al. | 139/383 A |
| 5,542,455 | A | 8/1996 | Ostermayer et al. | 139/383 A |
| 5,555,917 | A | 9/1996 | Quigley | 139/383 A |
| 5,564,475 | A | 10/1996 | Wright | 139/383 A |
| 5,641,001 | A | 6/1997 | Wilson | 139/383 A |
| 5,651,394 | A | 7/1997 | Marchand | 139/383 |
| 5,709,250 | A | 1/1998 | Ward et al. | 139/383 A |
| 5,713,397 | A | 2/1998 | Quigley | 139/383 |
| RE35,777 | E | 4/1998 | Givin | 139/383 A |
| 5,746,257 | A | 5/1998 | Fry | 139/383 AA |
| 5,826,627 | A | 10/1998 | Seabrook et al. | 139/383 A |
| 5,857,498 | A | 1/1999 | Barreto et al. | 139/383 |
| 5,881,764 | A | 3/1999 | Ward | 139/383 A |
| 5,894,867 | A | 4/1999 | Ward et al. | 139/383 |
| 5,899,240 | A | 5/1999 | Wilson | 139/383 |
| 5,937,914 | A | 8/1999 | Wilson | 139/383 A |
| 5,967,195 | A | 10/1999 | Ward | 139/383 |
| 5,983,953 | A | 11/1999 | Wilson | 139/383 |
| 6,073,661 | A | 6/2000 | Wilson | 139/383 |
| 6,112,774 | A | 9/2000 | Wilson | 139/383 |
| 6,123,116 | A * | 9/2000 | Ward et al. | 139/383 A |
| 6,145,550 | A * | 11/2000 | Ward | 139/383 A |
| 6,148,869 | A | 11/2000 | Quigley | 139/383 |
| 6,158,478 | A | 12/2000 | Lee et al. | 139/383 |
| 6,179,965 | B1 * | 1/2001 | Cunnane et al. | 162/358.2 |
| 6,202,705 | B1 | 3/2001 | Johnson et al. | 139/383 |
| 6,207,598 | B1 * | 3/2001 | Lee et al. | 442/206 |
| 6,227,255 | B1 | 5/2001 | Osterberg et al. | |
| 6,237,644 | B1 * | 5/2001 | Hay et al. | 139/383 A |
| 6,240,973 | B1 * | 6/2001 | Stone et al. | 139/383 A |
| 6,244,306 | B1 | 6/2001 | Troughton | 139/383 |
| 6,253,796 | B1 * | 7/2001 | Wilson et al. | 139/383 A |
| 6,276,402 | B1 * | 8/2001 | Herring | 139/383 A |
| 6,379,506 | B1 | 4/2002 | Wilson et al. | 162/348 |
| 6,581,645 | B1 * | 6/2003 | Johnson et al. | 139/383 A |
| 6,585,006 | B1 * | 7/2003 | Wilson et al. | 139/383 A |
| 6,896,009 | B2 * | 5/2005 | Ward | 139/383 A |
| 2003/0010393 | A1 | 1/2003 | Kuji | |
| 2004/0079434 | A1 | 4/2004 | Martin et al. | |

FOREIGN PATENT DOCUMENTS

| | | | |
|---|---|---|---|
| EP | 0 158 710 | 10/1984 | D03D/1/00 |
| EP | 0 185 177 | 10/1985 | D03D/11/00 |
| EP | 0 224 276 | 12/1986 | |
| EP | 0 264 881 | 10/1987 | D21F/1/00 |
| EP | 0 269 070 | 11/1987 | D03D/11/00 |
| EP | 0 284 575 | 2/1988 | D21F/1/00 |
| EP | 0 283 181 | 3/1988 | D21F/1/00 |
| EP | 0 350 673 | 6/1989 | D21F/1/00 |
| EP | 0 408 849 A2 | 5/1990 | D21F/1/00 |
| EP | 0 408 849 A3 | 5/1990 | |
| EP | 0 672 782 | 3/1995 | D21F/1/00 |
| EP | 0 794 283 A1 | 9/1997 | D21F/1/00 |
| EP | 1 273 698 | 1/2003 | D21F/1/10 |
| FR | 2 597 123 | 4/1986 | D03D/11/00 |
| FR | 8605115 | 4/1986 | |
| GB | 2157328 A | 10/1985 | D03D/1/00 |
| GB | 2245006 | 2/1991 | D03D/11/00 |
| JP | 2-277848 | 11/1990 | D03D/15/00 |
| JP | 8-158285 | 12/1994 | |
| JP | 9-41282 | 7/1995 | |
| JP | 9-87990 | 9/1995 | |
| WO | WO 86/00099 | 1/1986 | D21F/1/00 |
| WO | WO 89/09848 | 4/1989 | D03D/23/00 |
| WO | WO 93/10304 | 11/1992 | D21F/1/10 |
| WO | WO 99/61998 | 12/1999 | D21F/1/00 |
| WO | WO 02/00996 | 1/2002 | D21F/1/00 |
| WO | WO 2004/038094 | 5/2004 | D21F/1/00 |

OTHER PUBLICATIONS

International Search Report for PCT Application No. PCT/US97/18629.

Rule 132 Declaration of Robert G. Wilson (Jun. 26, 1997).

Pictures and related description of prior art fabric, undated, admitted prior art.

Kufferath Geoflex 328 XL 328, undated, admitted prior art.

* cited by examiner

MACHINE DIRECTION YARN STITCHED TRIPLE LAYER PAPERMAKER'S FORMING FABRICS

RELATED APPLICATIONS

This application claims priority to and is a continuation of parent application number 10/391,827, filed Mar. 19, 2003 U.S. Pat. No. 6,896,009, the disclosure of which is incorporated by reference in its entirety as if set forth fully herein.

FIELD OF THE INVENTION

The present invention relates generally to papermaking, and relates more specifically to forming fabrics employed in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

As used herein, the terms machine direction ("MD") and cross machine direction ("CMD") refer, respectively, to a direction aligned with the direction of travel of the papermakers' fabric on the papermaking machine, and a direction parallel to the fabric surface and traverse to the direction of travel. Likewise, directional references to the vertical relationship of the yarns in the fabric (e.g., above, below, top, bottom, beneath, etc.) assume that the papermaking surface of the fabric is the top of the fabric and the machine side surface of the fabric is the bottom of the fabric.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are now commercially available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

Typically, finely woven fabrics such as those used in fine paper and tissue applications include at least some relatively small diameter machine direction or cross machine direction yarns. Regrettably, however, such yarns tend to be delicate, leading to a short surface life for the fabric. Moreover, the use of smaller yarns can also adversely affect the mechanical stability of the fabric (especially in terms of skew resistance, narrowing propensity and stiffness), which may negatively impact both the service life and the performance of the fabric.

To combat these problems associated with fine weave fabrics, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paperside fabric layer and a separate, coarser machine side fabric layer. In these fabrics, which are part of a class of fabrics generally referred to as "triple layer" fabrics, the two fabric layers are typically bound together by separate stitching yarns. However, they may also be bound together using yarns from one or more of the sets of bottom and top cross machine direction and machine direction yarns. As double and triple layer fabrics include additional sets of yarn as compared to single layer fabrics, these fabrics typically have a higher "caliper" (i.e., they are thicker) than comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, U.S. Pat. No. 5,437,315 to Ward and U.S. Pat. No. 5,967,195 to Ward.

SUMMARY OF THE INVENTION

The present invention relates to machine direction yarn stitched triple layer papermaker's forming fabrics which can exhibit relatively good drainage, permeability and machine direction yarn stacking characteristics.

In one embodiment of the present invention, a triple layer papermaker's forming fabrics has a set of top MD yarns that are interwoven exclusively with a set of top CMD yarns to form at least part of a top fabric layer having a papermaking surface, and a set of bottom MD yarns that are interwoven exclusively with a set of bottom CMD yarns to form at least part of a bottom fabric layer having a machine side surface. These fabrics further include a set of stitching MD yarn pairs. The stitching MD yarns that comprise each such pair weave in both the top fabric layer and the bottom fabric layer such that at locations where the first yarn in the pair weaves in the top fabric layer the second yarn in the pair drops down into the bottom fabric layer. In this manner the two stitching MD yarns in each pair together complete the weave in the top fabric layer and bind the top fabric layer and the bottom fabric layer together. In certain embodiments of the present invention, at least one stitching MD yarn pair is provided adjacent each top MD yarn. Additionally, the top MD yarns, the top CMD yarns, and the stitching MD yarn pairs may be woven to form a top fabric layer having a plain weave pattern. Each stitching MD yarn may also be woven so as to pass below the same bottom CMD yarn as does the bottom MD yarn directly adjacent to it. In some embodiments, each stitching MD yarn is woven so that it couples with one of the bottom MD yarns at locations where the stitching MD yarn passes below the bottom CMD yarns so that the stitching MD yarn and the bottom MD yarn form side-by-side machine-side machine direction knuckles.

Pursuant to another aspect of the present invention, at least some of the top CMD yarns that the stitching MD yarns pass over immediately before dropping down into the bottom fabric layer have a larger diameter and/or a higher modulus than the remainder of the top CMD yarns. The fabrics may also be constructed so that all of the yarns in the set of top MD yarns weave over the same top CMD yarns and so that the top CMD yarns that the top MD yarns pass over have a smaller diameter and/or a lower modulus than the remainder of the top CMD yarns.

In another embodiment of the present invention, the triple layer forming fabrics may be woven so that in each repeat unit of the fabric the first stitching MD yarn in each stitching MD yarn pair passes below the same bottom CMD yarn as does the bottom MD yarn directly adjacent to the second stitching MD yarn in each stitching MD yarn pair. In this embodiment, each stitching MD yarn may also couple with a non-adjacent bottom MD yarn at locations where each stitching MD yarn passes below one of the bottom CMD yarns.

In another embodiment of the present invention, a triple layer papermaker's forming fabrics has a set of top MD yarns that are interwoven exclusively with a set of top CMD yarns to form at least part of a top fabric layer having a papermaking surface, and a set of bottom MD yarns that are interwoven exclusively with a set of bottom CMD yarns to form at least part of a bottom fabric layer having a machine side surface. These fabrics further include a pair of additional MD yarns disposed on either side of each top MD yarn, where the first yarn of each pair weaves exclusively in the top fabric layer and the second yarn of each pair completes the weave of the first yarn on the papermaking surface and also weaves with the bottom fabric layer so as to bind the top fabric layer and the bottom fabric layers together. In this embodiment, the fabric may be woven so that the second yarn of each pair additional of MD yarns passes over no more than two top CMD yarns in any repeat of the fabric and/or passes over no more than a single top CMD yarn at a time. Additionally, in these embodiments the machine side surface may be woven in a 1×3 twill pattern.

In each of the above described embodiments, the papermaking surface of the fabric may be woven in a variety of different weave patterns, specifically including 1×2, 1×3, 1×4, 2×2 and 2×3 twill patterns and a 1×1 plain weave pattern.

Another aspect of the present invention includes methods of using a triple layer papermaker's forming fabric as described above for making paper.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the illustrated embodiments or other embodiments set forth herein; rather, these embodiments are provided so that this disclosure will be thorough and complete, and will fully convey the scope of the invention to those skilled in the art. In the figures, the dimensions of some components may be exaggerated for clarity.

One aspect of the present invention is directed to machine direction yarn stitched triple layer papermaker's forming fabrics that include both a top fabric layer and a bottom fabric layer. These fabrics are "true" triple layer fabrics in that they include sets of machine direction yarns and cross machine direction yarns that only weave in the top fabric layer, as well as sets of machine direction yarns and cross machine direction yarns that only weave in the bottom fabric layer. The fabrics also include pairs of adjacent machine direction yarns that together replace the equivalent of a single machine direction yarn in the weave pattern on the papermaking surface. These yarns are woven such that when one yarn in the pair is weaving in the top fabric layer so as to complete the weave pattern on the papermaking surface, the second yarn in the pair weaves below the papermaking surface. Throughout the fabric, these yarns trade these positions. At least one of the yarns in the pair also drops down to the bottom fabric layer at one or more points so as to bind the top and bottom fabric layers together. Herein, these yarn pairs are referred to as "stitching MD yarn pairs" (even in those embodiments in which only one yarn of the pair actually "stitches" with the bottom fabric layer). Individual yarns from these yarn pairs are typically referred to as a "stitching MD yarn."

Figure 1:
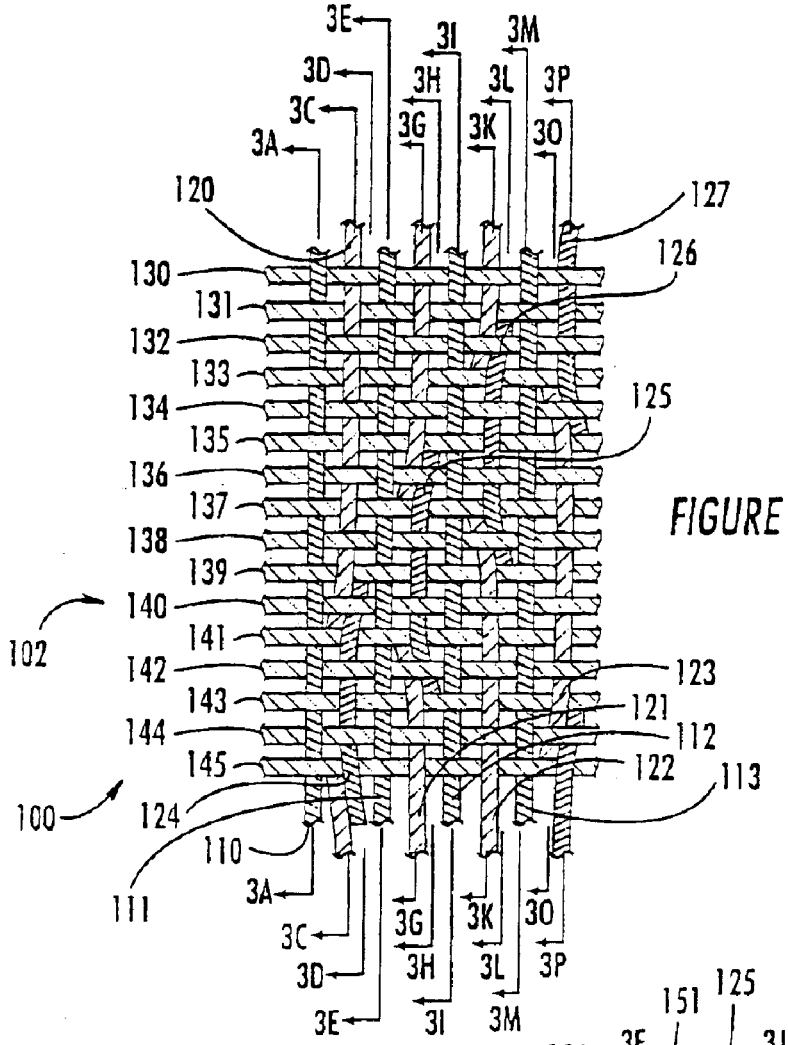
FIG. 1 is a top view of the top fabric layer of an embodiment of a 16 harness triple layer forming fabric of the present invention.
Figure 2:
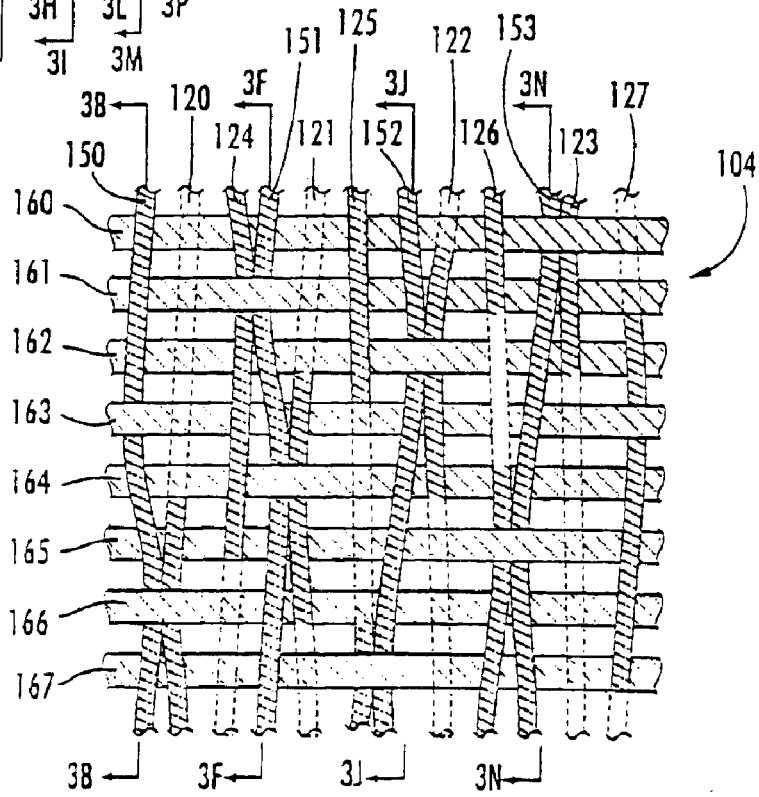
FIG. 2 is a top view of the bottom fabric layer of the triple layer forming fabric of FIG. 1.

An embodiment of the machine direction yarn stitched triple layer fabrics of the present invention is illustrated in FIGS. 1–3 and designated broadly at 100. FIG. 1 depicts a top view of the top fabric layer 102 of the triple layer fabric 100 (i.e., a view of the papermaking surface) while FIG. 2 depicts a top view of the bottom fabric layer 104 of fabric 100 (i.e., a view of the fabric 100 with the yarns that weave exclusively in the top fabric layer 102 removed). FIGS. 3A–3P depict the paths of each of the machine direction yarns in one repeat unit of the fabric 100. The triple layer fabric 100 of FIGS. 1–3 is woven on 16 harnesses, and hence a single repeat of the fabric encompasses 16 machine direction yarns. While FIGS. 1 and 2 only show a single repeat unit of the fabric, those of skill in the art will appreciate that in commercial applications the repeat unit shown in FIGS. 1 and 2 would be repeated many times, in both the machine and cross machine directions, to form a large fabric suitable for use on a papermaking machine.

As seen in FIG. 1, the repeat unit of the top fabric layer 102 includes a set of top MD yarns 110–113 and a set of top CMD yarns 130–145 that are interwoven together. The top fabric layer further includes a set of four stitching MD yarn pairs 120, 124; 121, 125; 122, 126; 123, 127 that also interweave with the top CMD yarns 130–145. As shown in FIG. 1, a stitching MD yarn pair, such as for example, stitching MD yarn pair 120, 124, is provided between each pair of adjacent top MD yarns, such as yarns 110–111. Each stitching MD yarn pair (such as pair 120, 124) is woven such that while one of the yarns of the pair (e.g., yarn 120) weaves in the top fabric layer 102 to complete the weave pattern in the top fabric layer 102, the other of the stitching MD yarns (e.g., yarn 124) drops down into the bottom fabric layer 104 to bind the top fabric layer 102 and the bottom fabric layer 104 together. In this manner, the stitching MD yarn pairs 120, 124; 121, 125; 122, 126; 123, 127 both complete the weave of the top layer fabric 102 and also serve to bind the top and bottom fabric layers 102, 104 together.

As shown in FIG. 1, the yarns comprising the set of top CMD yarns 130–145 are interwoven with the set of top layer MD yarns 110–113 and the stitching MD yarn pairs 120, 124; 121, 125; 122, 126; 123, 127 in a 1×1 or "plain weave" pattern, meaning that each of the top CMD yarns 130–145 alternatively pass below one, and then above the next, of the machine direction yarns that at that point are weaving in the papermaking surface. For example, top CMD yarn 130 passes below top MD yarn 110, above stitching MD yarn 120, below top MD yarn 111, above stitching MD yarn 121, below top MD yarn 112, above stitching MD yarn 122, below top MD yarn 113, and above stitching MD yarn 127. The other top CMD yarns 131–145 follow an identical "over one/under one" pattern, although this pattern is offset by one machine direction yarn for adjacent top CMD yarns 130–145.

Referring now to FIG. 2, a repeat unit of the top surface of the bottom fabric layer 104 of the fabric 100 is shown. The repeat unit includes a set of bottom MD yarns 150–153 which are interwoven with a set of bottom CMD yarns 160–167. The repeat unit further includes the stitching MD yarn pairs 120, 124; 121, 125; 122, 126; 123, 127 which are described above.

As shown best in FIG. 2, the bottom CMD yarns 160–167 may be constructed using relatively large diameter yarns that are well suited to sustain the wear caused by the friction between the machine side surface of the fabric 100 and the papermaking machine during use of the fabric 100. As can be seen in FIG. 2, the weave pattern of fabric 100 provides relatively long cross machine direction "floats" on the machine side surface, meaning that when viewing the machine side surface (i.e., the bottom surface) of the bottom fabric layer 104, the CMD yarns pass or "float" above large numbers of adjacent machine direction yarns. This may be advantageous in that it allows the larger, sturdier bottom CMD yarns 160–167 to primarily contact the papermaking machine.

As noted above, in the fabric depicted in FIGS. 1 and 2, the top fabric layer 102 (pictured in FIG. 1) and the bottom fabric layer 104 (pictured in FIG. 2) are bound together by the stitching MD yarn pairs 120, 124; 121, 125; 122, 126; 123, 127. In FIG. 1, only those portions of the stitching MD yarns 120–127 which weave with the top fabric layer 102 are depicted. In FIG. 2, the entirety of the stitching MD yarns 120–127 are shown, but those portions of the stitching warp yarn that weave in the top fabric layer are shown using dotted lines.

Figure 3A:
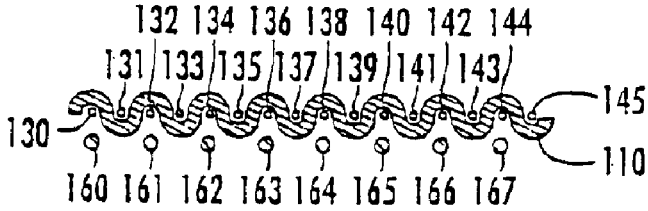
FIGS. 3A–3P are machine direction section views taken along the lines 3A—3A through 3P—3P of FIGS. 1 and 2.
Figure 3B:
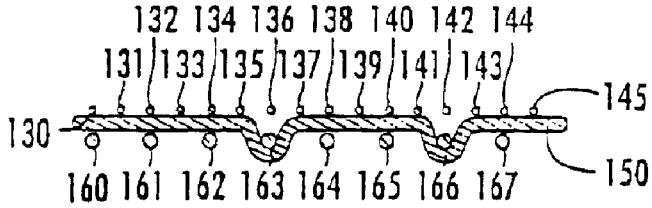
Figure 3C:
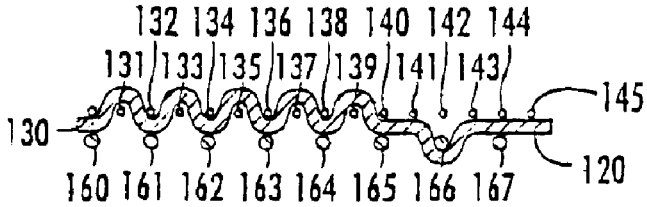
Figure 3D:
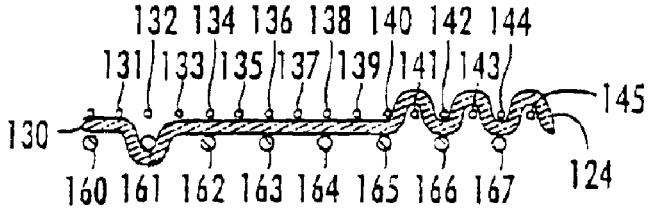
Figure 3E:
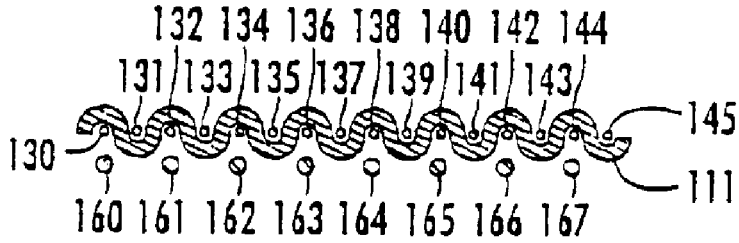
Figure 3F:
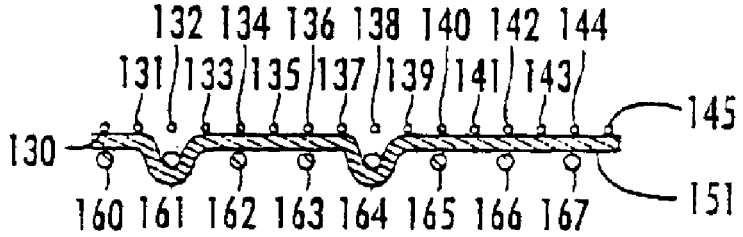
Figure 3G:
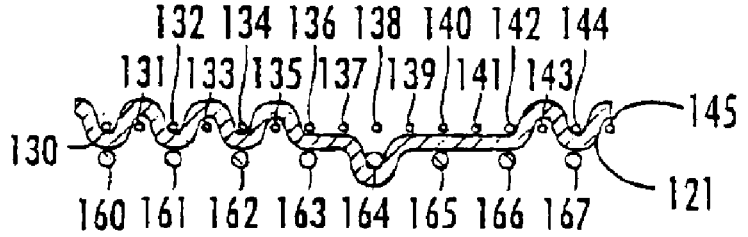
Figure 3H:
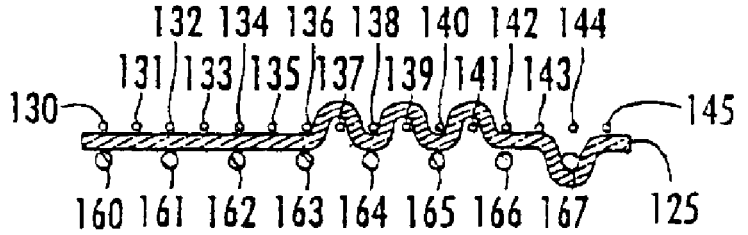
Figure 3I:
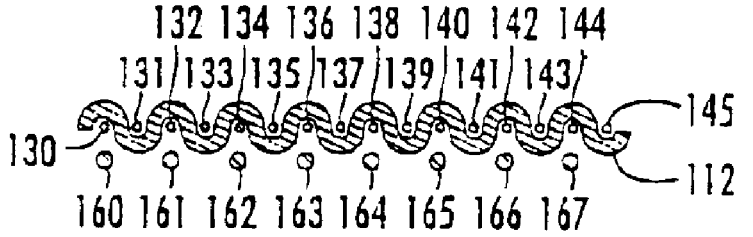
Figure 3J:
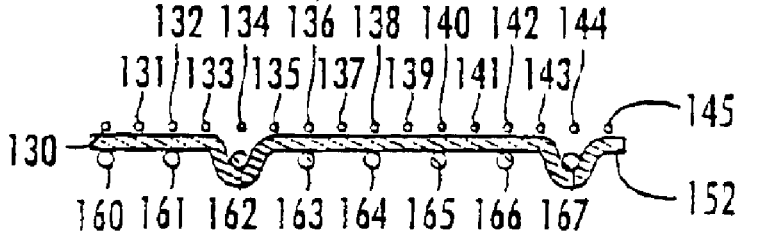
Figure 3K:
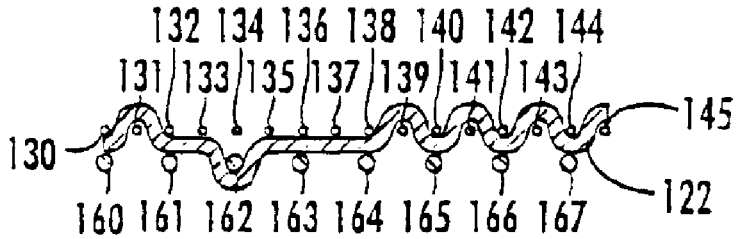
Figure 3L:
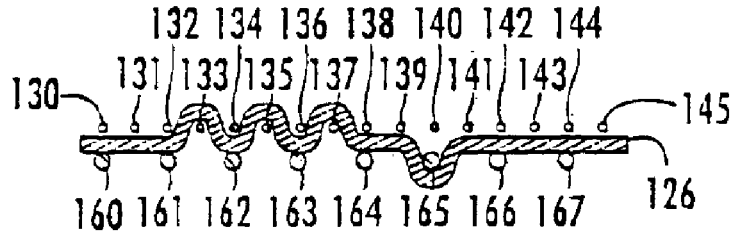
Figure 3M:
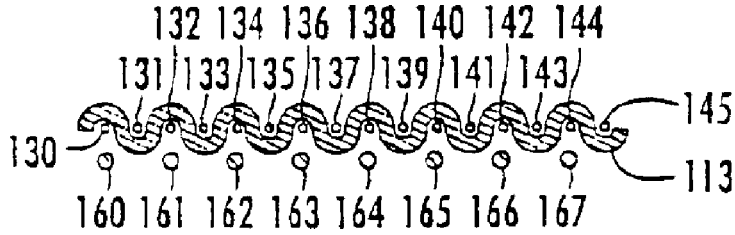
Figure 3N:
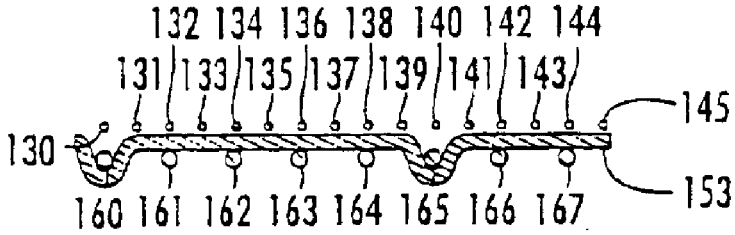
Figure 3O:
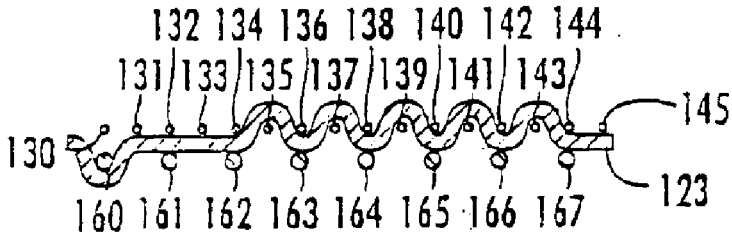
Figure 3P:
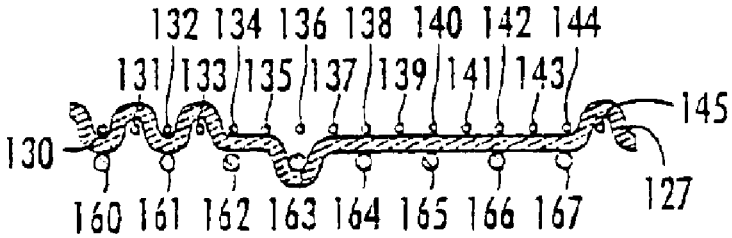

FIGS. 3A–3P depict the individual machine direction yarn paths of each of the sixteen MD yarns in one repeat of the fabric 100. As shown in FIGS. 3A, 3E, 3I and 3M, the top MD yarns 110–113 are-woven in identical over-one/under-one patterns with the top CMD yarns 130–145. These top MD yarns 110–113 do not weave with the bottom fabric layer 104. As shown in FIGS. 3B, 3F, 3J and 3K, the bottom MD yarns 150–153 are woven with the bottom CMD yarns 160–167 in an over-four/under-one/over-two/under-one pattern, meaning that each bottom MD yarn 150–153 passes over four yarns in the set of bottom CMD yarns 160–167, below the next bottom CMD yarn, above the next two bottom CMD yarns, and below the next bottom CMD yarn in each repeat unit of the fabric. For example, as shown in FIG. 3F, bottom MD yarn 151 passes above bottom CMD yarns 165–167 and 160, below bottom CMD yarn 161, above bottom CMD yarns 162–163, and below bottom CMD yarn 164. The other bottom CMD yarns 150, 152–153 follow a similar "over-four/under-one/over-two/under-one pattern" weave pattern, although this pattern is offset by two bottom CMD yarns 160–167 for each adjacent bottom MD yarn 151–153.

FIGS. 3C, 3G, 3K and 30 depict the individual machine direction yarn paths for stitching MD yarns 120, 121, 122 and 123, respectively. As shown, yarns 120–123 are woven in identical patterns with the top CMD yarns 130–145 and the bottom CMD yarns 160–167, with each stitching MD yarn 120–123 offset by two bottom CMD yarns (and hence four top CMD yarns) with respect to the stitching MD yarns 120–123 adjacent to it. As shown, for example, in FIG. 3C, stitching MD yarns 120–123 weave with the top CMD yarns 130–145 in an under-one/over-one/under-one/over-one/under-one/over-one/under-one/over-one/under-one/over-one/under-six pattern. The stitching MD yarns also interweave with the bottom CMD yarns 160–167 in an over-seven/under-one pattern.

FIGS. 3D, 3H, 3L and 3P depict the individual machine direction yarn paths for stitching MD yarns 124, 125, 126 and 127, respectively. As shown, yarns 124–127 are woven in identical patterns with the top CMD yarns 130–145 and the bottom CMD yarns 160–167, with each stitching MD yarn 124–127 offset by two bottom CMD yarns (and hence four top CMD yarns) with respect to the stitching MD yarns 124–127 adjacent to it. As shown, for example, in FIG. 3D, stitching MD yarns 120–123 weave with the top CMD yarns 130–145 in an under-eleven/over-one/under-one/over-one/under-one/over-one pattern. The stitching MD yarns 124–127 also interweave with the bottom CMD yarns 160–167 in an over-seven/under-one pattern.

As can be seen from FIGS. 1–3, only 50% of the machine direction yarns in the fabric 100 weave in both the top fabric layer 102 and the bottom fabric layer 104. As a result of this configuration, improved "stacking" of the yarns running in the machine direction may be obtained. Specifically, the top MD yarns 110–113 may be arranged so that they are substantially directly above the bottom MD yarns 150–153. Such an arrangement can provide desirable straight through drainage so that water reaching the top surface of the top fabric layer 102 meets relatively large drainage holes between the yarns that go straight through to the bottom of the bottom fabric layer 104. Such an arrangement can provide improved water drainage and easier cleaning, which is a desired fabric feature in many papermaking applications. Additionally, by having less than 100% of the machine direction yarns weaving in both the top and bottom fabric layers 102, 104, it is generally possible to increase permeability and uniformity as compared to an equivalent fabric formed with 67% or 100% of the machine direction yarns configured as stitching yarns such as the fabrics claimed in U.S. Pat. No. 6,202,705 or German patent WO 02/00996-02 A1. These features are also desirable in numerous papermaking applications.

As can also be seen in FIG. 2, each bottom MD yarn 150–153 alternatively comes together with or "couples" with the stitching MD yarns 120–127 that are adjacent to it on each side. Thus, for example, bottom MD yarn 151 couples with stitching MD yarn 121 in the vicinity of bottom CMD yarn 164, while it couples with stitching MD yarn 124 in the vicinity of bottom CMD yarn 161. The pairing occurs proximate the locations where the bottom MD yarns 150–153 pass below the bottom CMD yarns 160–167 such that they are in a position to be protected from coming in contact with the papermaking machine. Often, when two adjacent yarns "couple" in this manner persons of skill in the art refer to the two yarns as "pairing" at the locations where the yarns come together in the weave. However, to avoid confusion given the references to "stitching MD yarn pairs" in this application, the word "couples" will be used to describe situations where two yarns come together within the weave.

The coupling arrangement that occurs between the bottom MD yarns 150–153 and the stitching MD yarns 120–127 may have several beneficial effects in certain applications. First, by coupling at these locations each individual yarn may come into less contact with the papermaking machine since the yarns tend to act to protect each other. This may advantageously extend the life of the fabric, as a potential failure point for the fabric is wear of the MD yarns that come in contact with the papermaking machine. Additionally, having two MD yarns coupled at the locations where the MD yarns float below the CMD yarns potentially acts to increase the upward force on the bottom CMD yarn at that location. This increased upward force helps to "bury" the machine side MD yarn floats up into the bottom fabric layer 104, which further may help to reduce the machine-induced wear on the bottom MD yarns 150–153 and the stitching MD yarns 120–127. Third, as best seen in FIG. 2, a relatively large drainage hole is provided adjacent each location where the coupling occurs. These larger drainage holes may serve to facilitate drainage of water from the fabric 100.

In the embodiment of FIGS. 1–3, all of the stitching MD yarns 120–127 weave in both the top and bottom fabric layers 102, 104 to stitch the fabric layers together. It will be appreciated that not all of the stitching MD yarns need to perform such a stitching function, as is made clear in the description of the following fabric.

Figure 4:
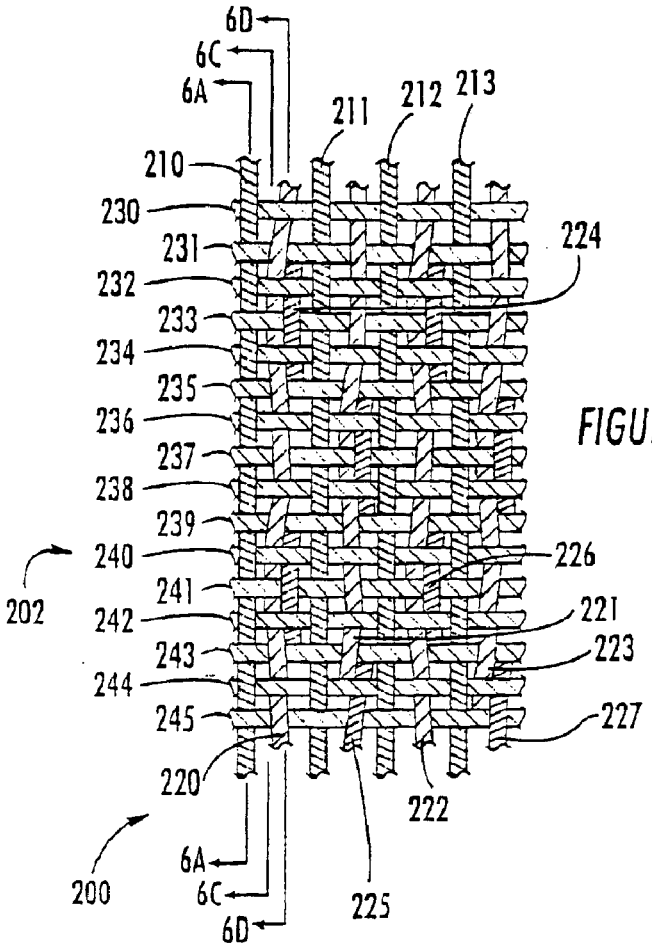
FIG. 4 is a top view of the top fabric layer of another embodiment of a 16 harness triple layer forming fabric of the present invention.
Figure 5:
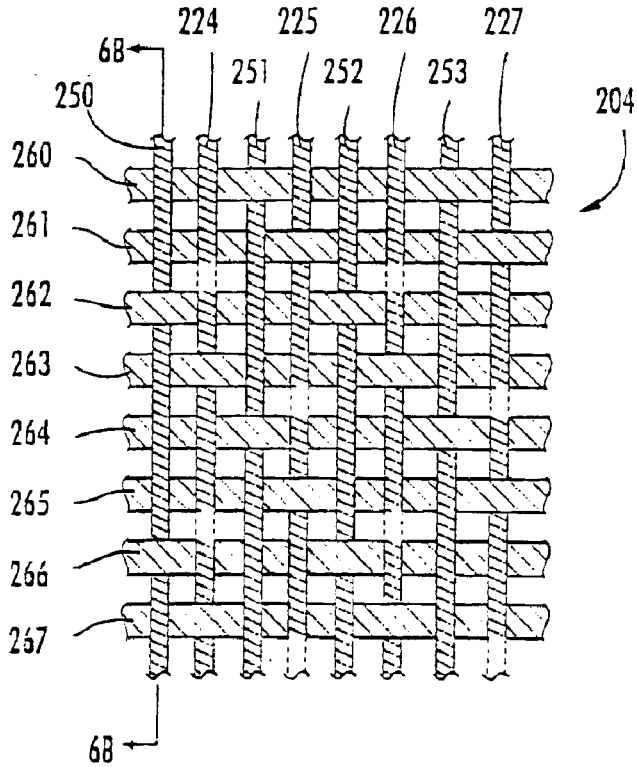
FIG. 5 is a top view of the bottom fabric layer of the triple layer forming fabric of FIG. 4.

Another fabric 200 constructed according to the teachings of the present invention is illustrated in FIGS. 4–6. FIG. 4 depicts a top view of the top fabric layer 202 of the triple layer fabric 200 (i.e., a view of the papermaking surface) while FIG. 5 depicts a top view of the bottom fabric layer 204 of fabric 200 (i.e., a view of the fabric 200 with the yarns that weave exclusively in the top fabric layer 202 removed). FIGS. 6A–6D depict the weave pattern of top MD yarn 210, bottom MD yarn 250, and stitching MD yarns 224 and 220, respectively. Those of skill in the art will appreciate that in commercial applications the depicted portion of the fabric would be repeated many times, in both the machine and cross machine directions.

As seen in FIG. 4 the top fabric layer 202 includes a set of top MD yarns 210–213 and a set of top CMD yarns 230–245 that are interwoven together. The top fabric layer further includes a set of four stitching MD yarn pairs 220, 224; 221, 225; 222, 226; 223, 227 that also interweave with the top CMD yarns 230–245. As shown in FIG. 4, a stitching MD yarn pair, such as for example, stitching MD yarn pair 220, 224, is provided between each pair of adjacent top MD yarns (e.g., yarns 210–211). The stitching MD yarn pairs are woven such that while one of the yarns in the pair (e.g., yarn 220) weaves in the top fabric layer 202 to complete the weave pattern in the top fabric layer 202, the other yarn of the pair (e.g., yarn 224) drops below the papermaking surface. As best seen in FIGS. 6C and 6D, in the embodiment of fabric 200, only one of the two yarns in each stitching MD yarn pair (e.g., yarn 224 in stitching MD yarn pair 220, 224) drops down into the bottom fabric layer 204 to bind the top fabric layer 202 and the bottom fabric layer 204 together. The other yarn in the stitching MD yarn pair (e.g., yarn 220) drops below the papermaking surface and travels between the top fabric layer 202 and the bottom fabric layer 204 at positions in the weave where the second yarn in the stitching MD yarn pair (e.g., yarn 224) travels up to the papermaking surface to complete the weave of the top fabric layer 202.

Referring now to FIG. 5, the machine side surface of the bottom fabric layer 204 is shown. The bottom fabric layer 204 includes a set of bottom MD yarns 250–253 which are interwoven with a set of bottom CMD yarns 260–267. The repeat unit further includes stitching MD yarns 224–227 which, as noted above, weave in both the top fabric layer 202 and the bottom fabric layer 204 to bind the fabric layers together.

As shown in FIG. 5, the bottom CMD yarns 260–267 of fabric 200 may be constructed using relatively large diameter yarns that are well suited to sustain the wear caused by the papermaking machine during use of the fabric 200. As can also be seen in FIG. 5, the weave pattern of fabric 200 provides relatively long cross machine direction "floats" on the machine side surface.

Figure 6A:
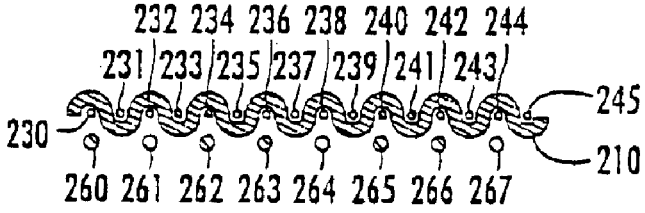
FIGS. 6A–6D are machine direction section views taken along the lines 6A—6A through 6D—6D of FIGS. 4 and 5.
Figure 6B:
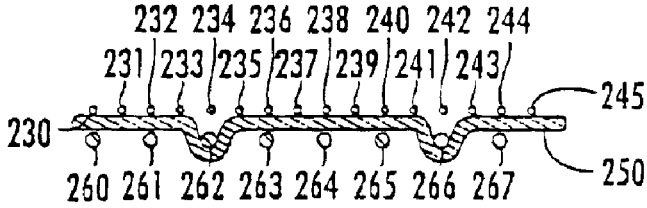
Figure 6C:
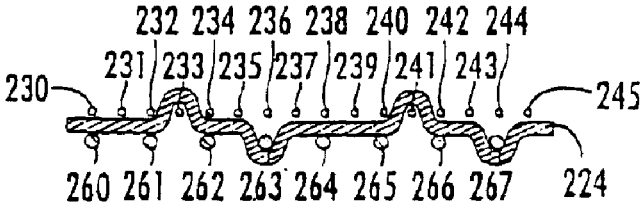
Figure 6D:
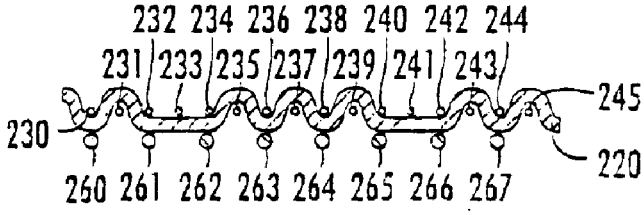

FIGS. 6A–6D depict the individual machine direction yarn paths of representative machine direction yarns in the fabric 200. FIG. 6A depicts the machine direction yarn paths for top MD yarn 210. Top MD yarns 211–213 are woven in identical weave patterns. As shown in FIG. 6A, each of these top MD yarns 210–213 are woven in over-one/under-one patterns with the top CMD yarns 230–245, and do not weave with any yarns in the bottom fabric layer 204.

FIG. 6B depicts the machine direction yarn path of bottom MD yarn 250. As shown in FIG. 6B, bottom MD yarn 250 weaves with the bottom CMD yarns 260–267 in an over-three/under-one/over-three/under-one pattern—i.e., it passes over bottom CMD yarns 267,260–261, passes under bottom CMD yarn 262, passes over bottom CMD yarns 263–265 and passes under bottom CMD yarn 266 in each repeat of the fabric. The other bottom MD yarns 251–253 follow a similar "over-three/under-one/over-three/under-one pattern" weave pattern, although the starting point for the pattern is offset by two bottom CMD yarns 260–267 for each adjacent bottom MD yarn 250–253.

FIG. 6C depicts the machine direction yarn path of stitching MD yarn 224. As shown in FIG. 6C, stitching MD yarn 224 is woven in an over-three/under-one/over-three/under-one pattern with respect to the bottom CMD yarns 260–267, and is woven in a over-seven/under-one/over-seven/under-one pattern with respect to the top CMD yarns 230–245. Stitching MD yarns 225–227 follow the same patterns with respect to the bottom CMD yarns 260–267 and the top CMD yarns 230–245 as stitching MD yarn 224, except that the starting point for the pattern is offset by two bottom CMD yarns 260–267 (and hence four top CMD yarns 230–245) for each adjacent stitching MD yarn 224–227.

FIG. 6D depicts the machine direction yarn path of stitching MD yarn 220. As shown in FIG. 6D, stitching MD yarn 220 is woven in an under-one/over-one/under-three/over-one/under-one/over-one/under-one/over-one/under-three/over-one/under-one/over-one pattern with respect to the top CMD yarns 230–245. Stitching MD yarn 220 does not weave with the bottom CMD yarns 260–267. Stitching MD yarns 221–223 follow the same patterns with respect to the top CMD yarns 230–245 as stitching MD yarn 220, except that the starting point for the pattern is offset by four top CMD yarns 230–245 for each adjacent stitching MD yarn 220–223.

As shown in FIGS. 6C and 6D, the stitching MD yarn pairs 220,224; 221, 225; 222, 226; 223, 227 weave in a "dropped knuckle pattern" to complete the weave in the papermaking surface. By "dropped knuckle pattern" it is meant that one of the yarns in each pair (yarns 220–223) substantially completes the weave in the papermaking surface, but occasionally the yarn skips one of the knuckles where it crosses over a top CMD yarn in its over-one/under-one pattern so as to allow the other yarn of the pair (yarns 224–227) to interlace with the top fabric layer. The dropped knuckle pattern may be advantageous in various applications as fine paper, newsprint and brown paper applications.

Pursuant to another aspect of the present invention, it will be realized that the position of the stitching MD yarns in the fabric may have a significant impact on fabric performance. For example, in the fabric 100 of FIGS. 1–3, stitching MD yarns 124–127 may be woven off the same warp beam as bottom MD yarns 150–153 and stitching MD yarns 120–123 may be woven off the same warp beam as top MD yarns 110–113. As can best be seen in FIG. 1, with this weaving configuration, in each stitching MD yarn pair the stitching MD yarns that form five knuckles per repeat on the papermaking surface (yarns 124–127) fall slightly to the left (from the vantage point of FIG. 1) of the stitching yarns that form three knuckles per repeat on the papermaking surface (yarns 120–123). Thus, for example, in FIG. 1 stitching MD yarn 120 falls slightly to the left of stitching MD yarn 124.

Figure 7:
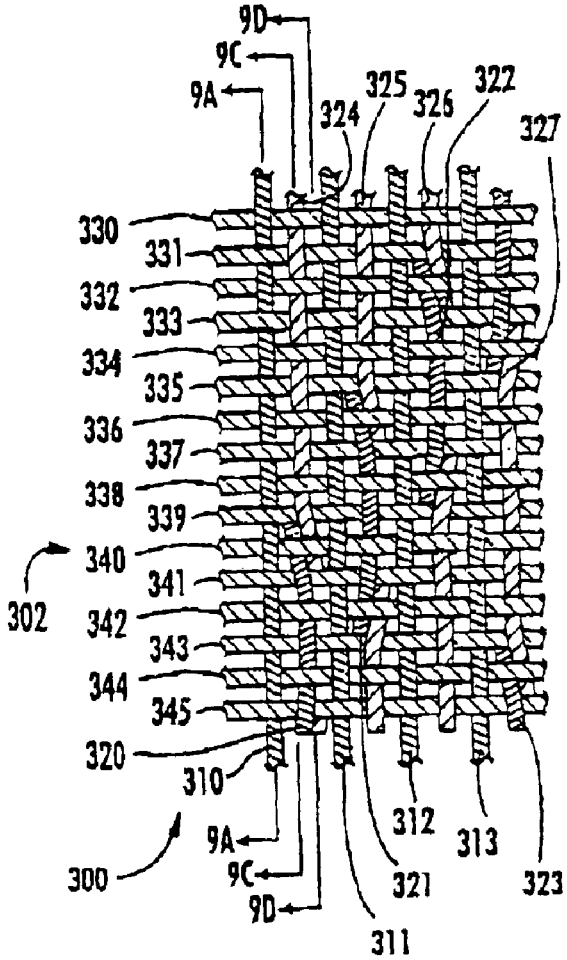
FIG. 7 is a top view of the top fabric layer of another embodiment of a 16 harness triple layer forming fabric of the present invention.

FIG. 7 depicts a top view of the top fabric layer 302 of a triple layer fabric 300 having the reverse weave on the stitching MD yarns. As seen in FIG. 7, the repeat unit of the top fabric layer 302 includes a set of top MD yarns 310–313 and a set of top CMD yarns 330–345 that are interwoven together. The top fabric layer further includes a set of four stitching MD yarn pairs 320, 324; 321, 325; 322, 326; 323, 327 that also interweave with the top CMD yarns 330–345 and that are provided between each pair of adjacent top MD yarns. The stitching MD yarn pairs are woven such that while one of the yarns in the pair (e.g., yarn 320) weaves in the top fabric layer 302 to complete the weave pattern in the top fabric layer 302, the other yarn of the pair (e.g., yarn 324) drops below the papermaking surface.

Figure 8:
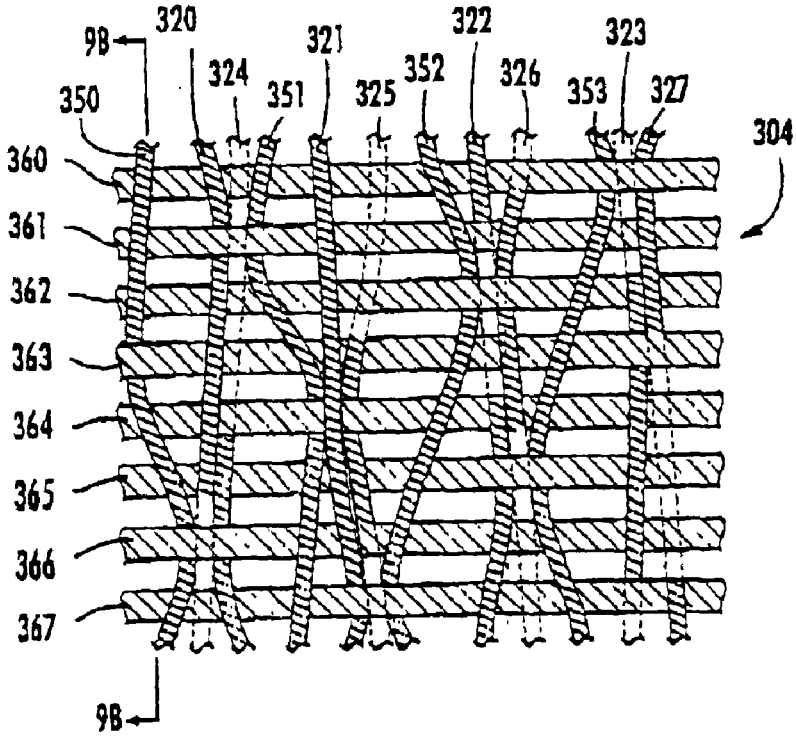
FIG. 8 is a top view of the bottom fabric layer of the triple layer forming fabric of FIG. 7.

FIG. 8 depicts a repeat unit of the machine side surface of the bottom fabric layer 304 of the fabric 300. The repeat unit includes a set of bottom MD yarns 350–353 which are interwoven with a set of bottom CMD yarns 360–367. The repeat unit further includes stitching MD yarns 320–327 which, as noted above, weave in both the top fabric layer 302 and the bottom fabric layer 304 to bind the fabric layers together.

Figure 9A:
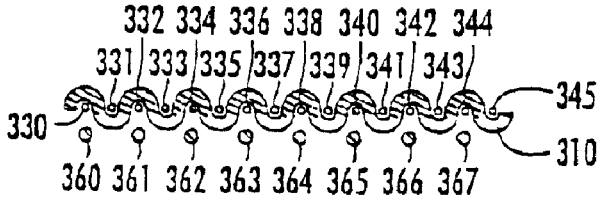
FIGS. 9A–9D are machine direction section views taken along the lines 9A—9A through 9D—9D of FIGS. 7 and 8.

FIGS. 9A–9D depict the individual machine direction yarn paths of representative machine direction yarns in the fabric 300. As shown in FIG. 9A, top MD yarn 310, as well as top MD yarns 311–313, are woven in over-one/under-one patterns with the top CMD yarns 330–345, and do not weave with any yarns in the bottom fabric layer 304.

Figure 9B:
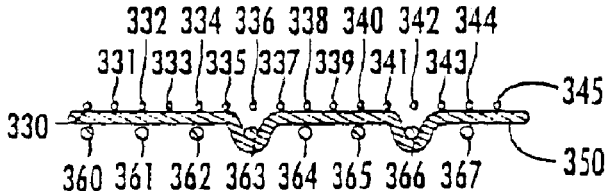

FIG. 9B depicts the machine direction yarn path of bottom MD yarn 350. As shown in FIG. 9B, bottom MD yarn 350 weaves with the bottom CMD yarns 360–367 in an over-four/under-one/over-two/under-one pattern—i.e., it passes over bottom CMD yarns 367,360–362, passes under bottom CMD yarn 363, passes over bottom CMD yarns 364–365 and passes under bottom CMD yarn 366 in each repeat of the fabric. The other bottom MD yarns 351–353 follow a similar "over-four/under-one/over-two/under-one pattern" weave pattern, although the starting point for the pattern is offset by two bottom CMD yarns 360–367 for each adjacent bottom MD yarn 350–353.

Figure 9C:
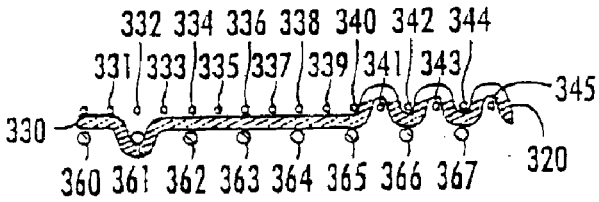

FIG. 9C depicts the machine direction yarn path of stitching MD yarn 320. As shown in FIG. 9C, stitching MD yarn 320 is woven in an over-seven/under-one pattern with respect to the bottom CMD yarns 360–367, and is woven in an under-eleven/over-one/under-one/over-one/under-one/over-one pattern with respect to the top CMD yarns 330–345. Stitching MD yarns 321–323 follow the same patterns with respect to the bottom CMD yarns 360–367 and the top CMD yarns 330–345 as stitching MD yarn 320, except that the starting point for the pattern is offset by two bottom CMD yarns 360–367 (and hence four top CMD yarns 330–345) for each adjacent stitching MD yarn 324–327.

Figure 9D:
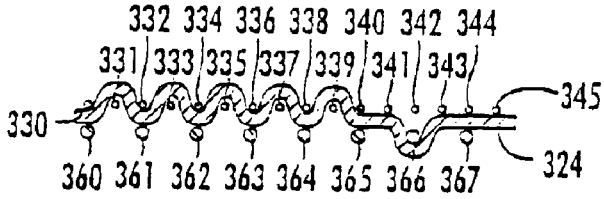

FIG. 9D depicts the machine direction yarn path of stitching MD yarn 324. As shown in FIG. 9D, stitching MD yarn 324 is woven in an under-one/over-one/under-one/over-one/under-one/over-one/under-one/over-one/under-one/over-one/under-six pattern with respect to the top CMD yarns 330–345. Stitching MD yarn 324 weaves with the bottom CMD yarns 360–367 in an over seven/under-one pattern. Stitching MD yarns 325–327 follow the same patterns with respect to the top CMD yarns 330–345 as stitching MD yarn 324, except that the starting point for the pattern is offset by four top CMD yarns 330–345 for each adjacent stitching MD yarn 324–327.

The fabric 300 depicted in FIGS. 7–9 is very similar to the fabric 100 depicted in FIGS. 1–3, the only difference being that the positions of the stitching MD yarn pairs are reversed in the two fabrics. Thus, in fabric 100, the stitching MD yarns 120–123 that form five knuckles per repeat on the papermaking surface fall to the left (from the vantage point of FIG. 1) of the stitching MD yarns 124–127 that form three knuckles per repeat on the papermaking surface, while in fabric 300 the stitching MD yarns 324–327 that form five knuckles per repeat on the papermaking surface fall to the right (from the vantage point of FIG. 7) of the stitching MD yarns 320–323 that form three knuckles per repeat on the papermaking surface.

As shown best in FIG. 8, reversing the position of the stitching MD yarns can result in a significant change in positioning of the yarns in the bottom fabric layer 304. In particular, the machine direction yarns weaving in the bottom fabric layer 304 take more of a zig-zag pattern (as compared to the bottom fabric layer 104 depicted in FIG. 2), which can improve the straight through drainage in fabric 300. The zig-zag pattern results because each stitching MD yarn tends to couple with a specific bottom MD yarn, namely the bottom MD yarn that passes underneath the same bottom CMD yarn as does the stitching MD yarn. In the fabric 300, each bottom MD yarn and the stitching MD yarn with which it pairs are separated by one other stitching MD yarn. As a result, each bottom MD yarn and the stitching MD yarns with which it alternatively couples must travel farther across the fabric to perform the alternative coupling, thereby providing more of a zig-zag pattern. By way of example, bottom MD yarn 351 couples with stitching MD yarn 320 where those two yarns pass under bottom CMD yarn 361. As shown in FIG. 8, stitching MD yarn 324 lies between (and above) bottom MD yarn 351 and stitching MD yarn 320. As a result, bottom MD yarn 351 tends to bend heavily to the left and stitching MD yarn 320 tends to bend heavily to the right so that the two yarns may couple together at the location where they both pass beneath bottom CMD yarn 361. Likewise, stitching MD yarn 321 lies between (and above) bottom MD yarn 351 and stitching MD yarn 325. Bottom MD yarn 351 thus tends to bend heavily to the right and stitching MD yarn 325 tends to bend heavily to the left so that the two yarns may couple together at the location where they both pass beneath bottom CMD yarn 364. This tendency of the bottom MD yarns and the stitching MD yarns (at locations where they weave in the bottom fabric layer) to lean first to the left and then to the right results in the zig-zag pattern.

Note that in fabric 300, the stitching MD yarns in each stitching MD yarn pair are pulled toward each other by the forces that cause those yarns to couple with the bottom MD yarns. As a result, the stitching MD yarns tend to align themselves approximately halfway between the bottom MD yarns (except at the locations where they couple with a bottom MD yarn), which provides for improved straight through drainage in the fabric. In contrast, in the fabric 100 of FIGS. 1–3, the stitching MD yarns in each stitching MD yarn pair are pulled away from each other toward the bottom MD yarn which they are adjacent to.

Figure 10:
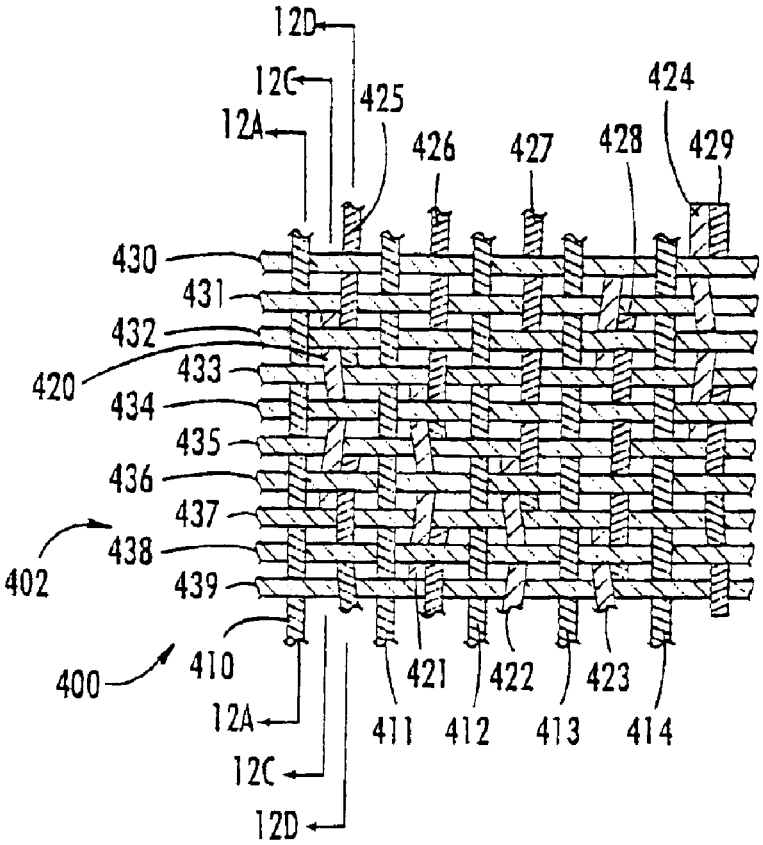
FIG. 10 is a top view of the top fabric layer of a 20 harness triple layer forming fabric of the present invention.
Figure 11:
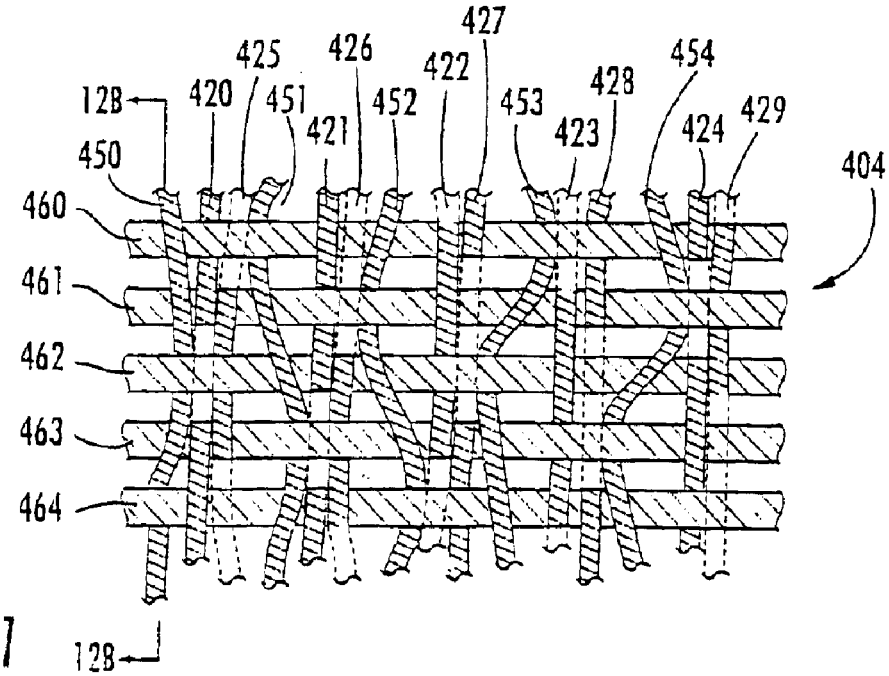
FIG. 11 is a top view of the bottom fabric layer of the triple layer forming fabric of FIG. 10.

The principles of the present invention can be extended to fabrics woven with different repeat patterns. For instance, a triple layer fabric 400 according to the present invention woven on 20 harnesses is depicted in FIGS. 10–12. FIG. 10 depicts a top view of the top fabric layer 402 of the triple layer fabric 400 (i.e., a view of the papermaking surface) while FIG. 11 depicts a top view of the bottom fabric layer 404 of fabric 400 (i.e., a view of the fabric 400 with the yarns that weave exclusively in the top fabric layer 402 removed). FIGS. 12A–12D depict the weave pattern of top MD yarn 410, bottom MD yarn 450, and stitching MD yarns 420 and 425, respectively. The triple layer fabric of FIGS. 10–12 is woven on twenty harnesses, and hence a single repeat of the fabric encompasses twenty machine direction yarns. While FIGS. 10 and 11 only show a single repeat unit of the fabric, those of skill in the art will appreciate that in commercial applications the depicted portion would be repeated many times, in both the machine and cross machine directions.

As seen in FIG. 10, the repeat unit of the top fabric layer 402 includes a set of top MD yarns 410414 and a set of top CMD yarns 430–439 that are interwoven together. The top fabric layer further includes a set of five stitching MD yarn pairs 420, 425; 421, 426; 422, 427; 423, 428; 424, 429 that also interweave with the top CMD yarns 430–439. As shown in FIG. 10, a stitching MD yarn pair, such as for example, stitching MD yarn pair 420, 425, is provided between each pair of adjacent top MD yarns (e.g., yarns 410–411). Each stitching MD yarn pair (such as pair 420, 425) is woven such that while one of the yarns of the pair (e.g., yarn 420) weaves in the top fabric layer 402 to complete the weave pattern in the top fabric layer 402, the other of the stitching MD yarns (e.g., yarn 425) drops down into the bottom fabric layer 404 to bind the top fabric layer 402 and the bottom fabric layer 404 together. In this manner, the stitching MD yarn pairs 420, 425; 421, 426; 422, 427; 423, 428; 424, 429 both complete the weave of the top layer fabric 402 and also serve to bind the top and bottom fabric layers 402, 404 together. As further shown in FIG. 10, the yarns comprising the set of top CMD yarns 430–439 are interwoven with the set of top layer MD yarns 410–414 and the stitching MD yarn pairs 420, 425; 421, 426; 422, 427;

423, 428; 424, 429 in a plain weave pattern, meaning that each of the top CMD yarns 430–439 alternatively pass below one, and then above the next, of the machine direction yarns that at that point are weaving in the papermaking surface.

Referring now to FIG. 11, a repeat unit of the machine side surface of the bottom fabric layer 404 of the fabric 400 is shown. The repeat unit includes a set of bottom MD yarns 450–454 which are interwoven with a set of bottom CMD yarns 460–464. The repeat unit further includes the stitching MD yarn pairs 420, 425; 421, 426; 422, 427; 423, 428; 424, 429 which are described above.

As shown in FIG. 11, the bottom CMD yarns 460–464 of fabric 400 may be constructed using relatively large diameter yarns that are well suited to sustain the wear caused by papermaking machine during use of the fabric 400. As can also be seen in FIG. 11, the weave pattern of fabric 400 provides relatively long cross machine direction "floats" on the machine side surface.

Figure 12A:
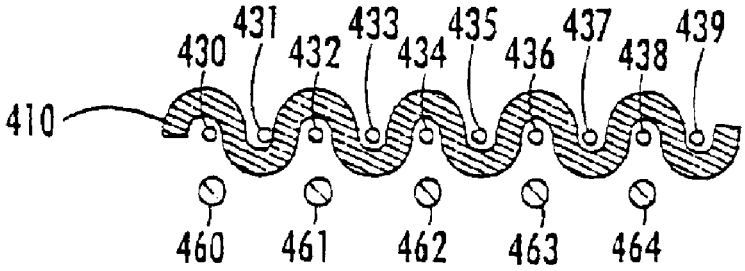
FIGS. 12A—12D are machine direction section views taken along the lines 12A—12A through 12D—12D in FIGS. 10 and 11.

FIGS. 12A–12D depict the individual machine direction yarn paths of representative machine direction yarns in the fabric 400. FIG. 12A depicts the machine direction yarn paths for top MD yarn 410. Top MD yarns 411–414 are woven in identical weave patterns. As shown in FIG. 12A, each of these top MD yarns 410–414 are woven in over-one/under-one patterns with the top CMD yarns 430–439 (and each top MD yarn 410–414 passes over the exact same top CMD yarns 430, 432, 434, 436, 438) and do not weave with any yarns in the bottom fabric layer 404.

Figure 12B:
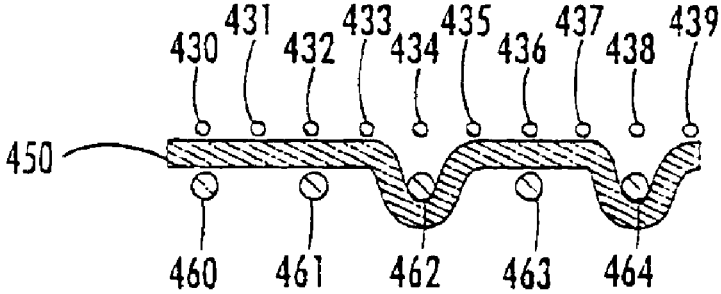

FIG. 12B depicts the machine direction yarn path of bottom MD yarn 450. As shown in FIG. 12B, bottom MD yarn 450 weaves with the bottom CMD yarns 460–464 in an over-two/under-one/over-one/under-one pattern—i.e., it passes over bottom CMD yarns 460–461, passes under bottom CMD yarn 462, passes over bottom CMD yarn 463 and passes under bottom CMD yarn 464 in each repeat of the fabric. The other bottom MD yarns 451–454 follow a similar "over-two/under-one/over-one/under-one pattern" weave pattern, although the starting point for the pattern is offset by one bottom CMD yarns 460–464 for each adjacent bottom MD yarn 450–454.

Figure 12C:
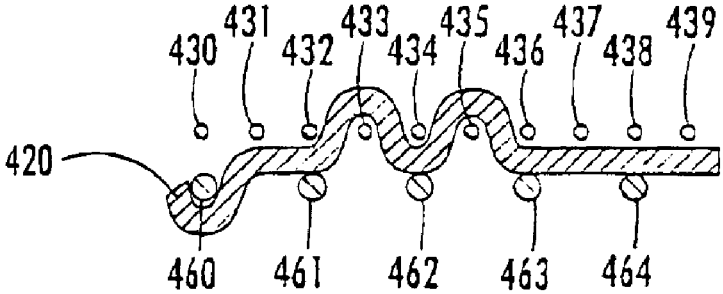

FIG. 12C depicts the machine direction yarn path of stitching MD yarn 420. As shown in FIG. 12C, stitching MD yarn 420 is woven in an under-one/over-four pattern with respect to the bottom CMD yarns 460–464, and is woven in a under-seven/over-one/under-one/over-one pattern with respect to the top CMD yarns 430–439. Stitching MD yarns 421–424 follow the same patterns with respect to the bottom CMD yarns 460–464 and the top CMD yarns 430–439 as stitching MD yarn 420, except that the starting point for the pattern is offset by one bottom CMD yarns 460–464 (and hence two top CMD yarns 430–439) for each adjacent stitching MD yarn 420–424.

Figure 12D:
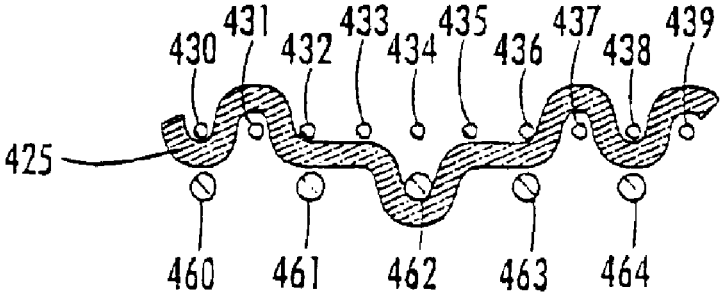

FIG. 12D depicts the machine direction yarn path of stitching MD yarn 425. As shown in FIG. 12D, stitching MD yarn 425 is woven in an over-four/under-one pattern with respect to the bottom CMD yarns 460–464, and is woven in a under-one/over-one/under-five/over-one/under-one/over-one pattern with respect to the top CMD yarns 430–439. Stitching MD yarns 426–429 follow the same patterns with respect to the top CMD yarns 430–439 as stitching MD yarn 425, except that the starting point for the pattern is offset by one bottom CMD yarns 460–464 (and hence two top CMD yarns 430–439) for each adjacent stitching MD yarn 425–429.

The present invention is directed to "true" triple layer fabrics—meaning triple layer fabrics that include (1) a set of MD yarns and a set of CMD yarns that each weave exclusively in a top fabric layer and (2) a set of MD yarns and a set of CMD yarns that each weave exclusively in a bottom fabric layer—that are stitched together by machine direction yarns. Such machine direction yarn stitched true triple layer fabrics may typically be manufactured less expensively than most high-performance cross machine direction yarn triple layer fabrics while providing improved fiber support (with the plain weave top surface) compared to conventional double layer fabrics. Pursuant to the teachings of the present invention, it will be appreciated that the machine direction yarn stitched true triple layer fabrics may have improved stacking of the machine direction yarns, increased permeability and higher void volumes as compared to double layer fabrics. Additionally, by using yarn pairs that complete the weave in the papermaking surface as the stitching yarns it is possible to bind the fabric together at numerous locations, thereby providing a very stable fabric that is not particularly susceptible to interlayer wear.

Each of the fabrics 100, 200, 300, 400 depicted in the figures includes MD stitching yarn pairs in which the yarns that comprise the pair interlace with the top fabric layer an unequal number of times in each repeat of the fabric. For example, as shown best in FIGS. 3B and 3C, each stitching MD yarn pair 120, 124; 121, 125; 122, 126; 123, 127 of fabric 100 include a stitching MD yarn (e.g., yarn 120) that interlaces with the top fabric layer 102 five time per repeat and a stitching MD yarn (e.g., yarn 124) that interlaces with the top fabric layer 102 three times per repeat unit of the fabric. This "unequal interlacing" configuration may provide improved fabric uniformity—particularly on the top surface. As will be appreciated by those of skill in the art, when the fabric is woven off two warp beams, the crimp of the warp yarns woven off each beam will be different. Thus, by weaving the top MD yarns off the same warp as the stitching MD yarns that interlace the greater number of times in the top fabric layer, it may be possible to provide for a more uniform papermaking surface.

Those of skill in the art will appreciate that numerous modifications can be made to the above described fabrics. By way of example, the stitching MD yarn pairs can have a wide variety of weave patterns in terms which they complete the weave of the top fabric layer. Thus, the number of top MD yarns that each stitching MD yarn passes over to complete the plain weave pattern on the papermaking surface may vary, as may the frequency with which the yarns pass in and out of the top fabric layer. Additionally, a variety of different weave patterns may be employed in the top fabric layer, specifically including 1×2 twill, 2×2 twill, 1×3 twill and 1×4 twill papermaking surfaces, as well as various derivatives of the above-mentioned weave patterns, specifically including broken twill patterns such as those embodied in 4 or 5 harness satin single layer fabrics, which are known in the art as providing a good papermaking surface. Likewise, the frequency of the stitch points and/or the ratio of top-to-bottom machine direction and/or cross machine direction yarns may be varied. Thus, the scope of the present invention should be construed based on the claims appended hereto, as opposed to the illustrative examples of the claimed fabrics which are provided herein to fully enable those of skill in the art to practice the claimed invention.

Another exemplary modification would be to alternate for each adjacent stitching MD yarn pair the warp beam from which the stitching MD yarns are woven. For example, the fabric of FIGS. 1–3 could be modified so that stitching MD yarns 120, 125, 122, 127 are woven off the same warp beam as top MD yarns 110–113 and stitching MD yarns 124, 121, 126, 123 are woven off the same warp beam as bottom MD yarns 150–153 to effect this modification. This reversal of the stitching yarn positions may reduce any diagonal pattern in the fabric and hence improve fabric performance.

Those of skill in the art will likewise appreciate that the stitching MD yarn pairs need not be included between every adjacent pair of top MD yarns. Instead, a stitching MD yarn pair may be provided after every second, third, fourth or fifth top MD yarn. Those of skill in the art will also appreciate that the frequency of interlacing can be varied from that shown in the fabrics pictured herein. However, the stitching MD yarns should sufficiently bind the upper and lower fabric layers together to prevent excessive movement between the fabric layers, as such excessive movement could result in severe inter-layer wear problems.

Yet another exemplary modification would be to shift the positions of the top fabric layer and the bottom fabric layer of the depicted embodiments (or other embodiments) relative to each other. For example, in the fabric 100 of FIGS. 1–3, the position of the top fabric layer 102 with respect to the bottom fabric layer 104 might be shifted by one top CMD yarn.

Pursuant to another aspect of the present invention, the size and or stiffness of selected of the top CMD yarns may be varied to improve fabric performance. As illustrated best in FIG. 1, the papermaking surface of certain fabrics made according to the present invention include "transition points" where one of the stitching MD yarns in a stitching MD yarn pair completes its run on the papermaking surface and dives down into the center of the fabric while the second yarn of the stitching MD yarn pair emerges from the center of the fabric to start its run on the papermaking surface. An example of such a transition point is the point where stitching MD yarns 120 and 124 pass under top CMD yarn 140 in FIG. 1. At these transition points the yarns of the stitching MD yarn pair enter or exit the fabric at a steeper angle as the yarns dive down to, or emerge from, a portion of their run where they weave with the bottom fabric layer 104. This steeper angle may decrease the crimp on the stitching MD yarns at the position where they pass over the last top CMD yarn adjacent to the transition point—i.e., where stitching MD yarn 120 passes over top CMD yarn 139 and where stitching MD yarn 124 passes over top CMD yarn 141—as the stitching MD yarn exerts sufficient force on the top CMD yarn to pull the top CMD yarn slightly farther into the middle of the fabric at this point. Pursuant to the teachings of the present invention, it will be understood that this reduction in the crimp of the stitching MD yarn knuckles adjacent the transition points can be reduced or eliminated by using slightly larger diameter top CMD yarns for the top CMD yarns that bracket each transition point. In the fabric of FIG. 1, this would mean making top CMD yarns 131, 133, 135, 137, 139, 141, 143, 145 slightly larger than top CMD yarns 130, 132, 134, 136, 138, 140, 142, 144. For example, if top CMD yarns 130, 132, 134, 136, 138, 140, 142, 144 are 0.15 millimeters in diameter, then top CMD yarns 131, 133, 135, 137, 139, 141, 143, 145 may be made 0.17 millimeters in diameter. Instead of modifying the diameter of top CMD yarns 131, 133, 135, 137, 139, 141, 143, 145, one may alternatively use stiffer yarns (i.e., yarns having a higher elastic modulus, such as an elastic modulus that is 50% higher) that will more effectively resist the tendency to be pulled into the fabric adjacent the transition points.

The use of larger diameter and/or higher modulus top CMD yarns may also improve uniformity of the papermaking surface at the transition points themselves. If such yarns are not used, the papermaking surface knuckle formed by the top CMD yarn directly over the transition point may be lower than the remainder of the knuckles formed by the top CMD yarns because the stitching MD yarns at that location dive down at a steeper angle and hence provide less support to the top CMD yarn. By using larger diameter or higher modulus yarns on the top CMD yarn positions that straddle the transition point it is possible to raise the height of the top CMD yarn that passes over the transition point at the transition point location.

Notably, in the bottom fabric layers 104, 204, 304, 404 of fabrics 100, 200, 300, 400, respectively, the set of bottom MD yarns and the set of bottom CMD yarns form a machine-side surface having only "single float" machine direction knuckles. By a "single float" machine-side machine direction knuckle it is meant that when the bottom fabric layer is viewed from the top, no machine direction yarn passes under more than one consecutive cross machine direction yarn (such that the MD yarn is on the machine-side surface) before passing back to the top surface of the bottom fabric layer. In a preferred embodiment of the triple layer forming fabrics of the present invention, the bottom fabric layer is woven so as to have a machine side surface composed exclusively of machine side "single float" machine direction knuckles.

The fabrics pictured and otherwise described and claimed herein may be employed in a variety of applications, including forming fine paper grades, tissue paper, brown paper and newsprint, but is especially beneficial of fine paper, newsprint and brown paper applications.

The configurations of the individual yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of polypropylene, polyester, nylon, or the like. The skilled artisan should select a yarn material according to the particular application of the final fabric.

Regarding yarn dimensions, the particular size of the yarns is typically governed by the mesh of the papermaking surface. In a typical embodiment of the triple layer fabrics disclosed herein, preferably the diameter of the top CMD yarns, and all of the MD yarns is between about 0.10 and 0.20 mm, and the diameter of the bottom CMD yarns is between about 0.22 and 0.50 mm. Those of skill in the art will appreciate that yarns having diameters outside the above ranges may be used in certain applications. In one embodiment of the present invention, the top CMD yarns and all of the MD yarns have diameters between about 0.15 and 0.17 mm, and the diameter of the bottom CMD yarns is between about 0.25 and 0.40 mm to provide fabrics with a target top mesh of 75×75 yarns per inch. Fabrics employing these yarn sizes may be implemented with polyester yarns or a combination of polyester and nylon yarns.

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paperstock is well understood by those of skill in the art, additional details regarding this aspect of the present invention will not be provided herein.

The foregoing embodiments are illustrative of the present invention, and are not to be construed as limiting thereof. The invention is defined by the following claims, with equivalents of the claims to be included therein.

That which is claimed:

1. A triple layer papermaker's forming fabric comprising:

a set of top CMD yarns;

a set of top MD yarns interwoven exclusively with the top CMD yarns to form at least part of a top fabric layer having a papermaking surface;

a set of bottom CMD yarns;

a set of bottom MD yarns interwoven exclusively with the bottom CMD yarns to form at least part of a bottom fabric layer having a machine side surface; and a set of stitching MD yarn pairs, wherein at least one of the stitching MD yarns in each stitching MD yarn pair weaves in both the top fabric layer and the bottom fabric layer and wherein the stitching MD yarns in each stitching MD yarn pair are woven such that at locations where the first of the two stitching MD yarns in each stitching MD yarn pair weaves in the top fabric layer the second of the two stitching MD yarns in the stitching MD yarn pair drops below the top fabric layer so that together the two stitching MD yarns in each stitching MD yarn pair complete the weave in the top fabric layer, and wherein at least some of the stitching MD yarns in the stitching MD yarn pairs bind the top fabric layer and the bottom fabric layer together; and wherein each stitching MD yarn couples with a respective one of the bottom MD yarns at locations where each stitching MD yarn passes below one of the bottom CMD yarns.

2. The papermaker's fabric of claim 1, wherein each stitching MD yarn couples with a non-adjacent bottom MD yarn at locations where each stitching MD yarn passes below one of the bottom CMD yarns.

3. The papermaker's fabric of claim 1, wherein each stitching MD yarn couples with an adjacent bottom MD yarn at locations where each stitching MD yarn passes below one of the bottom CMD yarns.

4. The papermaker's fabric of claim 1, wherein in each repeat of the fabric the first stitching MD yarn in each stitching MD yarn pair passes below the same bottom CMD yarn as does the bottom MD yarn directly adjacent to the second stitching MD yarn in each stitching MD yarn pair and the second stitching MD yarn in each stitching MD yarn pair passes below the same bottom CMD yarn as does the bottom MD yarn directly adjacent to the first stitching MD yarn in each stitching MD yarn pair.

5. The papermaker's forming fabric of claim 1, wherein the first of the two stitching MD yarns in each stitching MD yarn pair couples with a first one of the yarns in the set of bottom MD yarns at locations where the first of the two stitching MD yarns passes below a bottom CMD yarn, and the second of the two stitching MD yarns in each stitching MD yarn pair couples with a second one of the yarns in the set of bottom MD yarns that is different than the first one of the yarns in the set of bottom MD yarns at locations where the second of the two stitching MD yarns passes below a bottom CMD yarn.

6. The papermaker's forming fabric of claim 1, wherein no more than two machine-side machine direction knuckles are formed on any bottom CMD yarn in a single repeat of the fabric.

7. The papermaker's forming fabric of claim 1, wherein a stitching MD yarn pair is provided adjacent each top MD yarn.

8. The papermaker's forming fabric of claim 1, wherein the two stitching MD yarns in each pair of stitching MD yarns interlace with different numbers of top CMD yarns in each repeat of the fabric.

9. The papermaker's forming fabric of claim 1, wherein one of the two stitching MD yarns in each stitching MD yarn pair passes over no more than two top CMD yarns in any repeat of the fabric.

10. The papermaker's forming fabric of claim 1, wherein at least some of the top CMD yarns that the stitching MD yarns of the stitching MD yarn pairs pass over immediately before dropping down into the bottom fabric layer have a different modulus of elasticity and/or diameter than the remainder of the top CMD yarns.

11. The papermaker's fabric of claim 1, wherein the top CMD yarns that the top MD yarns pass over have a smaller diameter than the remainder of the top CMD yarns.

12. A triple layer papermaker's forming fabric comprising:

a set of top CMD yarns;

a set of top MD yarns interwoven exclusively with the top CMD yarns to form at least part of a top fabric layer having a papermaking surface;

a set of bottom CMD yarns;

a set of bottom MD yarns interwoven exclusively with the bottom CMD yarns to form at least part of a bottom fabric layer having a machine side surface; and a set of additional MD yarns, wherein the additional MD yarns are woven in pairs such that the first of the MD yarns in each additional MD yarn pair weaves in both the top fabric layer and the bottom fabric layer to bind the top fabric layer and the bottom fabric layer together and the second of the MD yarns in each additional MD yarn pair weaves exclusively in the top fabric layer;

wherein the MD yarns in each additional MD yarn pair are woven so that together the two MD yarns in each additional MD yarn pair complete the weave in the top fabric layer.

13. The papermaker's forming fabric of claim 12, wherein the MD yarns in each additional MD yarn pair together weave in the top fabric layer as the equivalent of a single yarn woven in an over-one-under-one pattern with the yarns comprising the set of top CMD yarns.

14. The papermaker's forming fabric of claim 12, wherein the second MD yarn in each additional MD yarn pair passes above a total of six of the top CMD yarns in each repeat of the fabric.

15. The papermaker's forming fabric of claim 14, wherein the first MD yarn in each additional MD yarn pair passes below a total of two of the bottom CMD yarns and above a total of two of the top CMD yarns in each repeat of the fabric.

16. The papermaker's forming fabric of claim 12, wherein each yarn in the set of bottom MD yarns passes below the same number of bottom CMD yarns as does each of the first of the MD yarns in each additional MD yarn pair.

17. The papermaker's forming fabric of claim 16, wherein, in each repeat of the fabric, the first MD yarn in each additional MD yarn pair forms two spaced-apart machine side machine direction knuckles and each bottom MD yarn forms two spaced-apart machine side machine direction knuckles, and wherein the number of bottom CMD yarns between the two spaced-apart machine side machine direction knuckles formed by the first MD yarn in each additional MD yarn pair is equal to the number of bottom CMD yarns between the two spaced-apart machine side machine direction knuckles formed by each bottom MD yarn.

18. The papermaker's fabric of claim 12, wherein an additional MD yarn pair is provided adjacent each top MD yarn.

19. The papermaker's fabric of claim 12, wherein each of the second MD yarns in each additional MD yarn pair weaves in the same pattern with respect to both the set of top CMD yarns and the set of bottom CMD yarns, except that the weave pattern is offset by a total of four top CMD yarns for adjacent of the second MD yarns in each additional MD yarn pair.

20. The papermaker's fabric of claim 12, wherein each additional MD yarn pair is woven in a dropped knuckle pattern.

21. The papermaker's fabric of claim 20, wherein the second of the MD yarns in each additional MD yarn pair drops every fourth machine direction knuckle on the papermaking surface.

22. The papermaker's fabric of claim 12, wherein the machine direction knuckles on the machine side surface form a twill pattern.

23. A triple layer papermaker's forming fabric, a repeat of which comprises:

a set of top weft yarns;

at least first and second top warp yarns, each of which is interwoven exclusively with at least some of the yarns in the set of top weft yarns to form at least part of a top fabric layer having an upper papermaking surface;

a set of bottom weft yarns;

at least first and second bottom warp yarns, each of which is interwoven exclusively with the bottom weft yarns to form at least part of a bottom fabric layer having a lower machine side surface; and at least a first pair of additional warp yarns provided between the first and second top warp yarns, the first pair of additional warp yarns including a first stitching warp yarn that interlaces with at least one of the yarns in the set of top weft yarns and at least one of the yarns in the set of bottom weft yarns to bind the top fabric layer and the bottom fabric layer together and a first filler warp yarn that weaves exclusively in the top fabric layer and which weaves under each yarn in the set of top weft yarns that the first stitching warp yarn weaves over, wherein the first stitching warp yarn is directly adjacent to the first filler warp yarn.

24. The papermaker's forming fabric of claim 23, wherein the first pair of additional warp yarns are woven so that together the first stitching warp yarn and the first filler warp yarn complete the weave in the top fabric layer.

25. The papermaker's forming fabric of claim 23, wherein the first pair of additional warp yarns is woven in a dropped knuckle pattern.

* * * * *